US007810270B2

(12) United States Patent
Fitzpatrick et al.

(10) Patent No.: US 7,810,270 B2
(45) Date of Patent: Oct. 12, 2010

(54) ADJUSTABLE CHEEK PIECE FOR A FIREARM BUTT STOCK

(75) Inventors: Richard Fitzpatrick, Longmont, CO (US); Michael T Mayberry, Denver, CO (US)

(73) Assignee: Magpul Industries Corporation, Boulder, CO (US)

( * ) Notice: Subject to any disclaimer, the term of this patent is extended or adjusted under 35 U.S.C. 154(b) by 513 days.

(21) Appl. No.: 12/013,226

(22) Filed: Jan. 11, 2008

(65) Prior Publication Data

US 2008/0236017 A1 Oct. 2, 2008

Related U.S. Application Data

(60) Provisional application No. 60/884,615, filed on Jan. 11, 2007.

(51) Int. Cl.
*F41C 23/00* (2006.01)

(52) U.S. Cl. ..... 42/73; 42/72; 42/71.01

(58) Field of Classification Search ..... 42/71.01, 42/72, 73, 74

See application file for complete search history.

(56) References Cited

U.S. PATENT DOCUMENTS 1,032,628 A 7/1912 Sherman
1,651,299 A 11/1927 Stansel
3,710,496 A 1/1973 Packmayr
4,122,623 A 10/1978 Stice (Continued)

OTHER PUBLICATIONS

Command Arms Accessories Online Catalog (2008) SRS Product Information.

(Continued)

*Primary Examiner*—Stephen M Johnson
*Assistant Examiner*—Daniel J Troy
(74) *Attorney, Agent, or Firm*—Swanson & Bratschun, L.L.C.

(57) ABSTRACT

A firearm butt stock with an adjustable cheek piece comprises an elongate stock base having a top, a bottom, a right side, a left side, a proximal end and a distal end. The stock base has a transverse pivot shaft near the stock base top and a transverse catch shaft spaced from the pivot shaft lengthwise of the stock base near the stock base top. A cheek piece has a proximal end and a distal end and a left and a right sidewall. The cheek piece defines a plurality of lengthwise stacked receptacles opening toward a proximal end of the cheek piece and an elongate hole having a distal and a proximal end spaced lengthwise and distal of the stacked receptacles. The stacked receptacles, the catch shaft, the elongate hole and the pivot shaft are configured so that with the pivot shaft received in the elongate hole and the pivot shaft at the distal end of the elongate hole, the catch shaft is received in one of the stacked receptacles and the cheek piece is prevented from pivoting about the pivot shaft. With the pivot shaft at the proximal end of the elongate hole, the catch shaft clears the opening of the stacked receptacles and the cheek piece can pivot about the pivot shaft. A spring detent is provided in operative association with one of the pivot shaft and the catch shaft. The spring detent prevents relative movement of the pivot shaft and the proximal and distal ends of the elongate hole without application of a lengthwise force to the cheek piece in a desired lengthwise direction of movement sufficient to overcome the spring detent.

17 Claims, 5 Drawing Sheets

U.S. PATENT DOCUMENTS

| | | | |
|---|---|---|---|
| 4,589,219 | A | 5/1986 | Milliman |
| 4,663,877 | A | 5/1987 | Bragg |
| 4,896,446 | A | 1/1990 | Gregory |
| 5,031,348 | A | 7/1991 | Carey |
| 5,075,995 | A | 12/1991 | Kennel |
| 5,933,997 | A | 8/1999 | Barrett |

OTHER PUBLICATIONS

Heckler & Koch Online Catalog (2008) PSG1A1 Product Information.

Magpul Online Catalog (2007) PRS Ar15/M16 Product Information.

Magpul Online Catalog (2007) FAL Preproduction Product Information.

U.S. Appl. No. 29/302,198, filed Jan. 11, 2008, Fitzpatrick.

ADJUSTABLE CHEEK PIECE FOR A FIREARM BUTT STOCK

RELATED APPLICATIONS

This application claims priority from U.S. Provisional Patent Application Ser. No. 60/884,615, filed Jan. 11, 2007, entitled "Firearm," which is hereby incorporated by reference.

TECHNICAL FIELD

The present invention is directed toward firearm butt stocks, and more particularly to an adjustable check piece for a firearm butt stock.

BACKGROUND

Historically, firearm butt stocks have been made in a non-adjustable fixed configuration. Butt stock height can be important because an accurate marksman typically rests his face against the comb or top of the stock, which is also known as the cheek rest. In most instances where the standard firearm sights are fixedly attached to the firearm barrel, non-adjusting stocks do not present a serious problem. However, with the advent and prevalence of telescopic optical sights which ride above the standard firearm sights and standard government issue military firearms taking on broader missions from urban warfare to sniper attacks, greater versatility in the height of the cheek rest is necessary.

By way of illustration, adjusting the cheek rest height typically has been considered necessary only for precision-sniper weapons. The extensive use of telescopic sights on these platforms makes eye alignment with these sighting devices of paramount importance. Looseness between the operator's head and the stock can cause misalignment between the eye and the stock and the scope. Issues such as maintaining proper eye relief and parallax are also effected. These scopes are often mounted too high above the stock for a user's cheek to gain a steadying purchase on the cheek rest. These effects all combine to potentially reduce firing accuracy.

For target applications and most military sniper applications, a high level of precision in position of a cheek rest is highly desirable. Thus, most firearm butt stocks having an adjustable cheek piece have relatively complex mechanisms requiring numerous components. The net effect is this often makes the stocks heavier, more difficult to assemble and more expensive to produce. Furthermore, these mechanisms are more prone to interference by dirt and grit encountered in military field applications. This is especially true with regard to government standard issue firearms which, as discussed above, are adaptable to numerous applications from use as sniper weapons to automatic weapons in relatively close combat.

The adjustable cheek piece for a firearm butt stock disclosed and claimed herein is intended to provide a simple, reliable and inexpensive solution to one or more of the problems discussed above.

SUMMARY OF THE EMBODIMENTS

A first aspect of the invention is a firearm butt stock with an adjustable cheek piece. The firearm butt stock comprises an elongate stock base having a top, a bottom, a right side, a left side, a proximal end and a distal end. The stock base has a transverse pivot shaft near the stock base top and a transverse catch shaft spaced from the pivot shaft lengthwise of the stock base near the stock base top. A cheek piece has a proximal end and a distal end and a left and a right sidewall. The cheek piece defines a plurality of lengthwise stacked receptacles opening toward a proximal end of the cheek piece and an elongate hole having a distal and a proximal end spaced lengthwise and distal of the stacked receptacles. The stacked receptacles, the catch shaft, the elongate hole and the pivot shaft are configured so that with the pivot shaft received in the elongate hole and the pivot shaft at the distal end of the elongate hole, the catch shaft is received in one of the stacked receptacles and the cheek piece is prevented from pivoting about the pivot shaft. With the pivot shaft at the proximal end of the elongate hole, the catch shaft clears the opening of the stacked receptacles and the cheek piece can pivot about the pivot shaft. A spring detent is provided in operative association with one of the pivot shaft and the catch shaft. The spring detent prevents relative movement of the pivot shaft and the proximal and distal ends of the elongate hole without application of a lengthwise force to the cheek piece in a desired lengthwise direction of movement sufficient to overcome the spring detent.

In one embodiment the spring detent comprises the elongate hole being peanut-shaped with a proximal lobe and a distal lobe separated by a waist, the waist having a width less than a diameter of the pivot shaft, and at least one of the cheek piece and the pivot shaft being formed of a resilient material. In such an embodiment the cheek piece may have a pair of peanut-shaped holes axially aligned in the left and right sidewalls and the elongate base may have a pair of pivot shafts axially aligned and extending from the right side and the left side of the stock base near the stock base top, with the left and right pivot shafts being received in the left and right peanut-shaped holes, respectively. Such an embodiment may further include the cheek piece sidewalls defining opposing lengthwise slots in an inner surface forming the plurality of lengthwise stacked receptacles and the elongate base includes a pair of catch shafts axially aligned and extending from the right side and the left side of the a stock base near the stock base top receivable in the lengthwise receptacles. The cheek piece and the pivot shafts may be formed of the same resilient material. The resilient material may be a resilient polymer and the cheek piece as well as the elongate stock base may be integrally formed from the resilient polymer.

Another aspect is a firearm comprising an upper receiver, a grip housing, a barrel, and a butt stock including an adjustable cheek piece in the various embodiments as described above.

DETAILED DESCRIPTION

Figure 1:
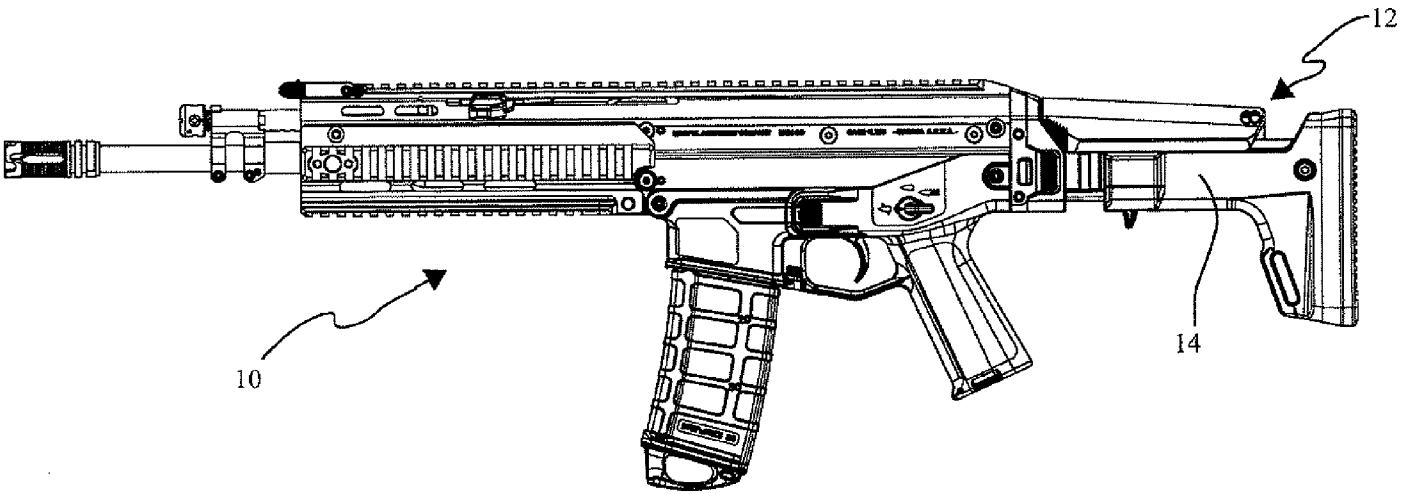
FIG. 1 is a left side elevation view of a fire arm incorporating the adjustable cheek piece for a firearm butt stock.

FIG. 1 is a side elevation view of a firearm 10 incorporating an adjustable cheek piece 12 on a firearm butt stock 14. The butt stock 14 with the adjustable cheek piece 12 is shown with the grip housing, upper receiver and barrel of the firearm 10 removed for the sake of clarity. The adjustable cheek piece 12 is comprised generally of a cheek piece 16 and an elongate stock base 18 upon which the cheek piece 16 rides.

Figure 3:
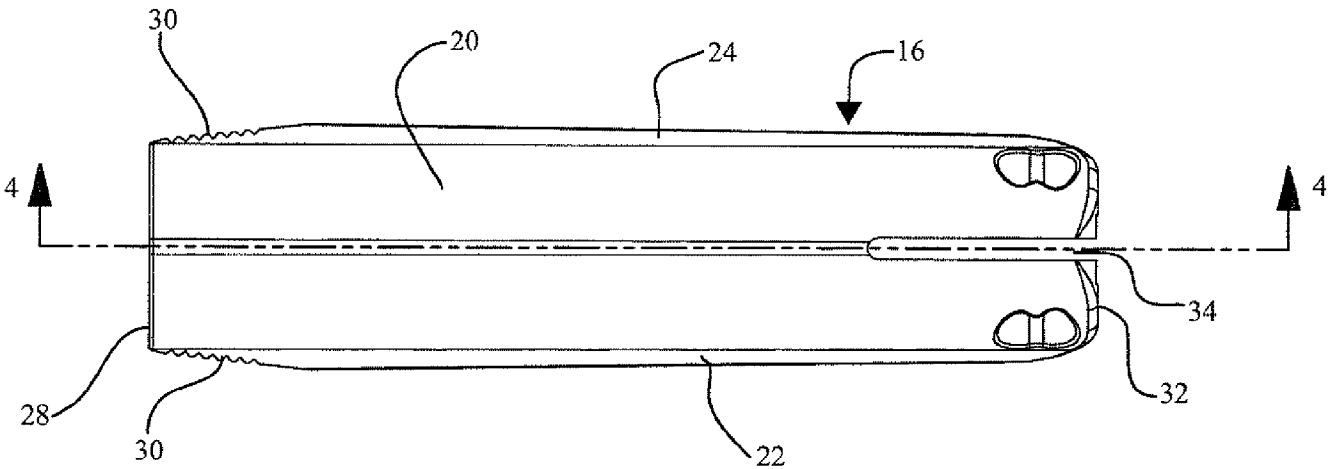
FIG. 3 is a top plan view of a cheek piece comprising the adjustable cheek piece for a firearm butt stock.
Figure 4:
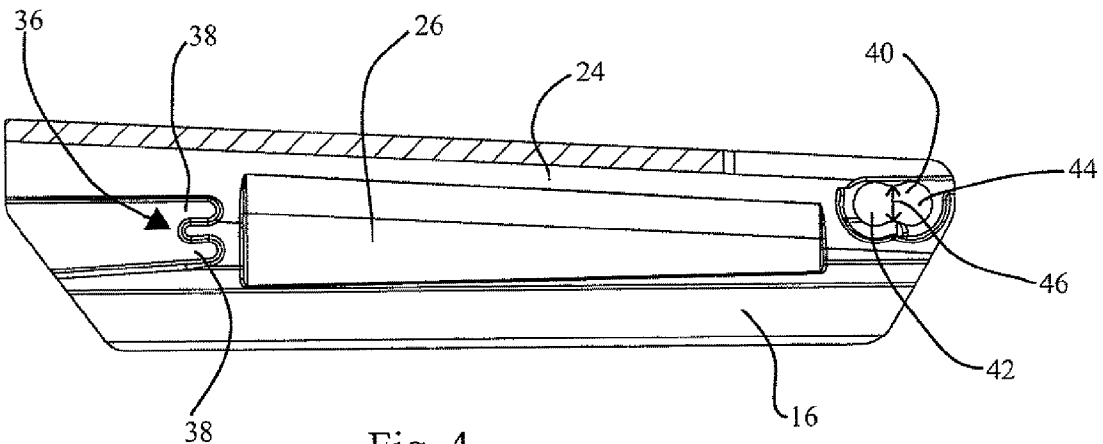
FIG. 4 is a cross-sectional view of the cheek piece of FIG. 3 taken along line 4-4 of FIG. 3.

FIG. 3 is a top view of the cheek piece 16. FIG. 4 is a cross-section of the cheek piece 16 taken along line 4-4 of FIG. 3. The cheek piece 16 comprises a top 20, a left sidewall 22 and a right sidewall 24 which enclose a cavity 26. The sidewalls near the proximal ends 28 are textured as illustrated at 30 and at the distal end 32 the top 20 has a lengthwise slot 30. As used herein, proximal and distal refer to the location relative to the grip housing of the assembled firearm 10 illustrated in FIG. 1.

Referring to FIG. 4, the cheek piece 16 defines a plurality of stacked receptacles 36 opening toward a proximal end of the cheek piece 16 near the proximal end of the cheek piece 16. The lengthwise stacked receptacles 36 consist of opposing lengthwise slots 38 which are axially aligned on an interior surface of the left and right sidewalls 22, 24. The opposing lengthwise slots 38 on an interior surface of the right sidewall are illustrated in FIG. 4 and mirror image opposing lengthwise slots 38 are provided in the inner surface of the left sidewall 22.

At the distal end of the cheek piece 16 is an elongate hole 40. More particularly, a pair of axially aligned elongate holes 40 are defined in the left and right sidewalls with the hole 40 in the right sidewall 24 being the only one shown in FIG. 4. The elongate hole 40 is peanut-shaped and comprises a proximal lobe 42 and a distal lobe 44 separated by a constricted waist 46. Referring to FIG. 4, the proximal lobe 42 and the distal lobe 44 are spaced along the length of the cheek piece 16.

Figure 5:
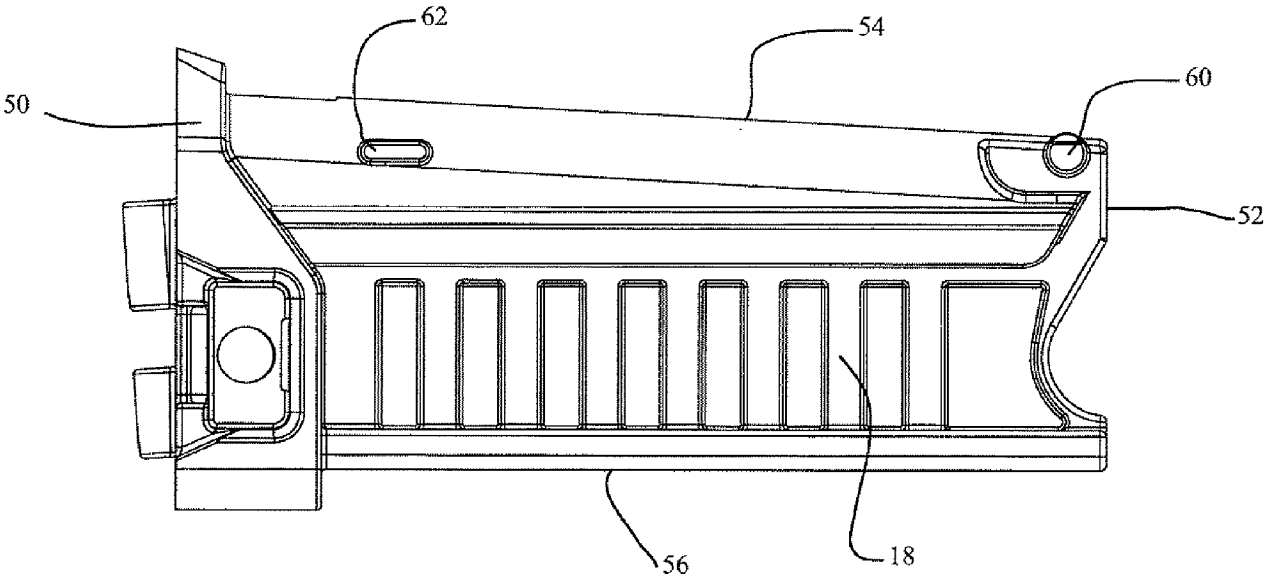
FIG. 5 is a left side elevation view of an elongate stock base comprising the adjustable cheek piece for a firearm butt stock.
Figure 6:
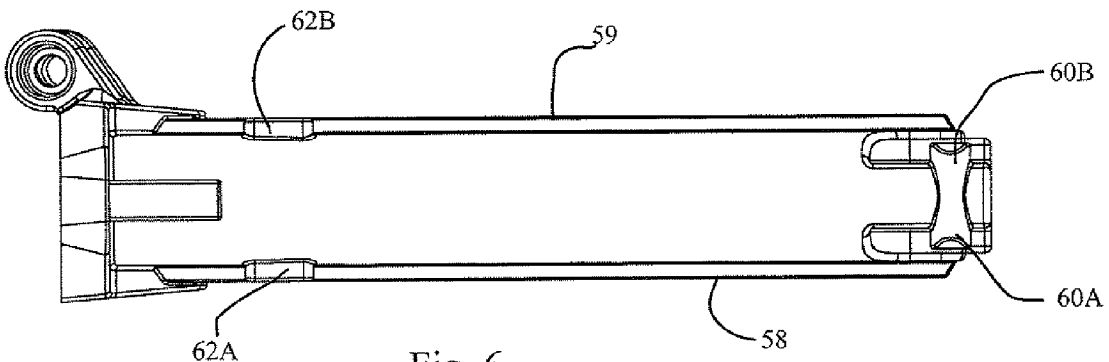
FIG. 6 is a top plan view of the stock base of FIG. 5.

FIG. 5 depicts an elongate stock base 18 having a proximal end 50, a distal end 52, a top 54, a bottom 56, a left side 58, and a right side 59. Near the top 54 at the distal end 52 of the stock base 18 is a transverse pivot shaft 60. Spaced lengthwise of the transverse pivot shaft 60 near the top 54 and the proximal end 50 of the stock base 18 is a transverse catch shaft 62. More particularly, referring to FIG. 6, in the present embodiment the transverse pivot shaft 60 comprises a pair of axially aligned pivot shafts 60A and 60B extending from the left and right sides of the stock base near the stock base top. Similarly, the transverse catch shaft 62 comprises a pair of axially aligned shafts 62A and 62B extending from the left and right side of the stock base 18, respectively.

Figure 2:
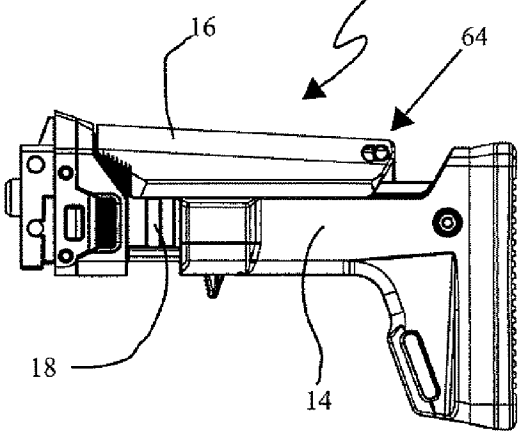
FIG. 2 is a left side elevation view of the butt stock of the firearm of FIG. 1 incorporating the adjustable cheek piece.

The pivot shafts 60A, 60B are sized to be received in the elongate hole 40 with the catch shaft 62 being receivable in the opposing lengthwise slots 38. More particularly, the transverse pivot shafts 60A, 60B, the transverse catch shafts 62A, 62B, the elongate holes 40 and the opposing lengthwise slots 38 of the stacked receptacles 36 are configured so that with the pivot shaft received in the elongate hole and the pivot shaft at the distal end of the elongate hole, the catch shaft is received in one of the stacked receptacles 36 and the cheek piece 16 is prevented from pivoting about the pivot shaft 60. With the pivot shaft 60 at the proximal end of the elongate hole 40, the catch shaft 62 clears the opening of the stacked receptacles 36 and the cheek piece 16 can pivot about the pivot shaft to be brought into alignment with a select stacked receptacle 36. A spring detent 64 (see FIG. 2) is formed by a relationship between the transverse pivot shaft 60 and the peanut-shaped hole 40. More particularly, the peanut-shaped hole is sized so that the waist 46 has a width slightly less than an outer diameter of the pivot shaft 60. In the embodiment described in detail herein, both the cheek piece 16 and the elongate stock base 18, including the transverse pivot shaft and the transverse catch shaft are integrally formed from a resilient material. However, only one of the transverse pivot shaft and a portion of the cheek piece defining the peanut-shaped hole need be made of a resilient material. By virtue of the resiliency, proximal and distal lobes 42, 44 can be moved lengthwise relative to the transverse pivot shaft 60 by application of a lengthwise force to the cheek piece 16 in a desired lengthwise direction of movement sufficient to overcome the spring detent 64.

The resilient material from which the cheek piece 16 and the elongate stock base (including the transverse pivot shaft 60A and 60B and transverse catch shaft 62A and 62B) are formed and can be any material with sufficient resiliency to provide the spring detent feature described above. In one embodiment the resilient material is a resilient polymer. Representative polymers include nylon, polypropylene, styrene and other synthetic organic polymers. The resilient material may include glass fiber reinforced polymers and the polymers may include impact modifiers. The detent action should be sufficient to prevent inadvertent lengthwise movement of the cheek piece 16 relative to the elongate stock base 18. For example, the detent should be able to resist movement from firing recoil and normal handling and use of the firearm. In other words, it should typically move only under deliberate application of force by a user.

The specific configuration of the elongate slot 40, the stacked receptacles 36 of the cheek piece 16, the transverse pivot shaft 60A and 60B and transverse catch shaft 62A and 62B are best viewed with reference to FIGS. 7A-7D. These figures illustrate the cheek piece in cross-section, generally as described in FIG. 4, though with various details omitted for clarity.

Figure 7A:
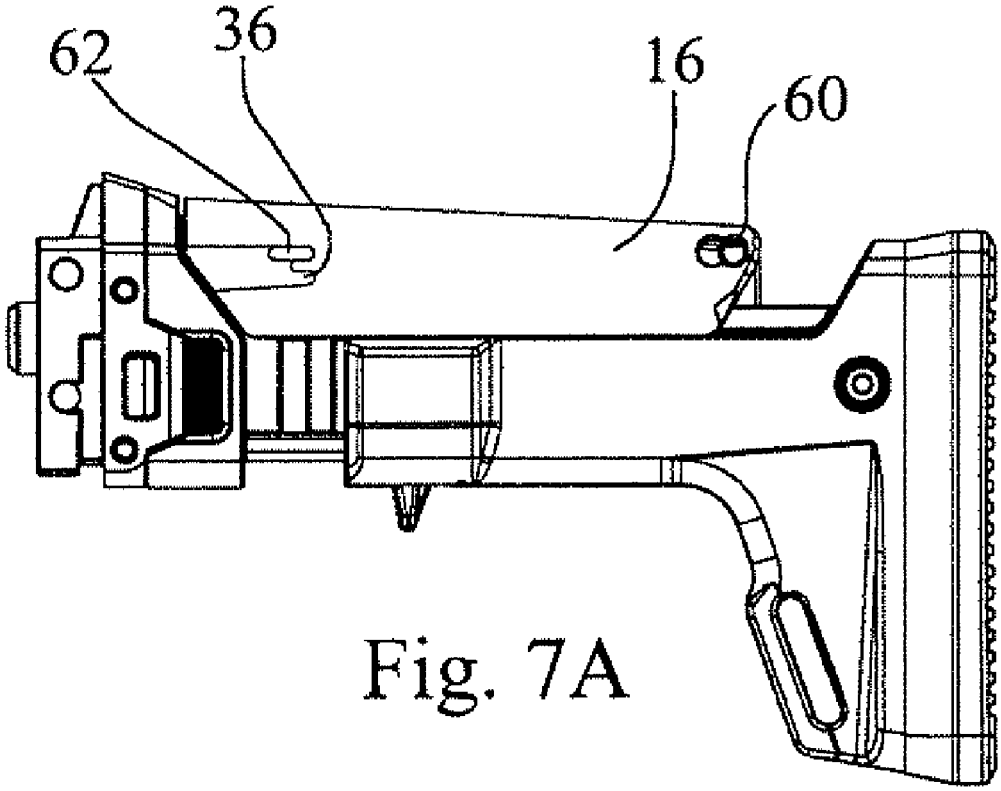
FIGS. 7A-7D are left side elevations views illustrating height adjustment of the adjustable cheek piece for a firearm butt stock.
Figure 7B:
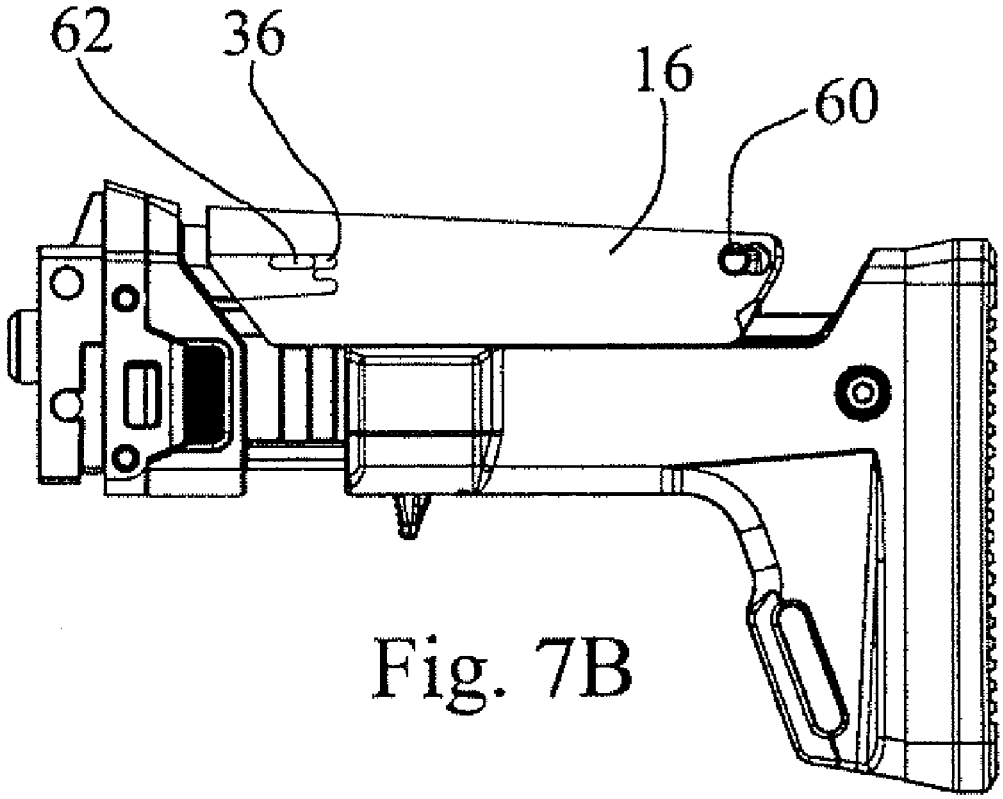
Figure 7C:
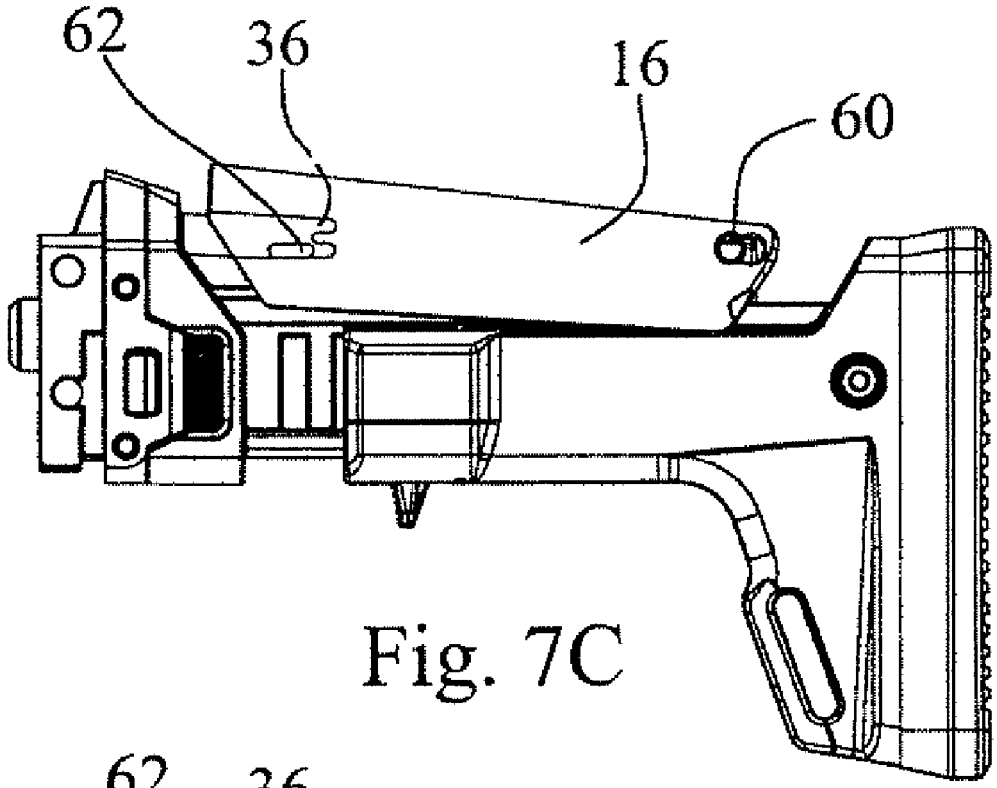
Figure 7D:
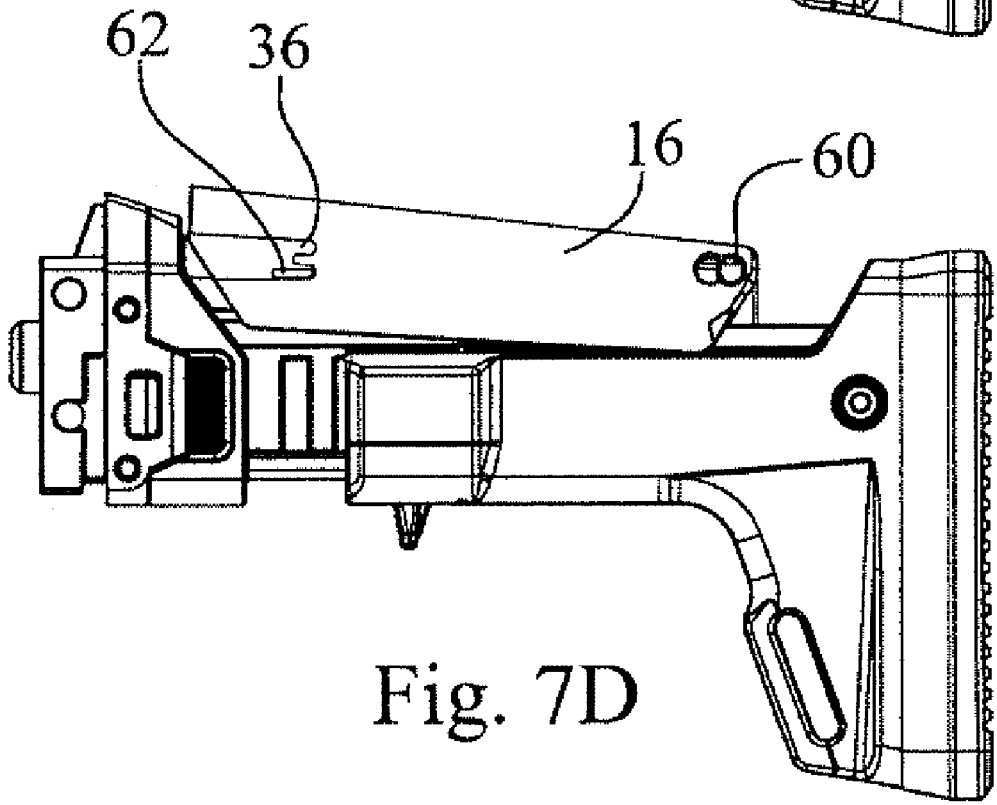

FIG. 7A illustrates the cheek piece 16 in a lowered locked position. The pivot shaft 60 is received in the distal lobe 44 of the peanut-shaped hole 40 and the transverse catch shaft 62 is received in an upper stacked receptacle 36. In this position the cheek piece 16 is locked against lengthwise movement and is prevented from pivoting about the pivot shaft 60. In FIG. 7B the cheek piece 16 has been slid lengthwise in a distal direction to move the transverse pivot shaft 60 into the proximal lobe 42 of the peanut-shaped hole 40. In this position the cheek piece 16 can pivot about the pivot shaft 60 and, as illustrated in FIG. 7C, can be brought into alignment with the lower stacked receptacle to effectively raise the level of the cheek piece 16. With the cheek piece thus aligned, a proximal lengthwise force can be applied to the cheek piece 16 to move the distal lobe 44 into engagement with the pivot shaft thus locking the cheek piece in a raised position and preventing further pivoting of the cheek piece about the pivot shaft 60, as illustrated in FIG. 7D.

The embodiment described herein has two stacked receptacles 36. Any number of stacked receptacles could be provided for greater degree of variation and precision of variation of height of the cheek piece 16. In addition, in the embodiment described herein the transverse catch shaft 62A and 62B has a flattened as opposed to a round cross-section to provide greater surface area in contact with the portions of the cheek piece side wall defining the stacked receptacles 36.

The slot 34 at the distal end of the top 20 of the cavity 26 is provided to facilitate attachment of the cheek piece 16 to the elongate stock base 18.

The adjustable cheek piece for a firearm butt stock can be reliably and inexpensively manufactured. For example, the cheek piece 16 and the stock base 18 may be integrally formed by injection molding of a resilient polymer. In addition, the cheek piece can be readily assembled and disassembled. The disclosed embodiments also provide a highly simplified and reliable spring detent system for securing the adjustable cheek piece at a desired height.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims. All references cited herein are incorporated in their entirety by reference.

What is claimed is:

1. A firearm butt stock comprising:

an elongate stock base having a top, a bottom, a right side, a left side, a proximal end and a distal end, the stock base having a transverse pivot shaft near the stock base top and a transverse catch shaft spaced from the pivot shaft lengthwise of the stock near the stock base top;

a cheek piece having a proximal end a distal end and left and right sidewalls, the cheek piece defining a plurality of lengthwise stacked receptacles opening toward a proximal end of the cheek piece and an elongate hole having a distal and a proximal end spaced lengthwise and distal of the stacked receptacles, the stacked receptacles, the catch shaft, the elongate hole and the pivot shaft being configured so that with the pivot shaft received in the elongate hole and the pivot shaft at the distal end of the elongate hole, the catch shaft is received in one of the stacked receptacles and the cheek piece is prevented from pivoting about the pivot shaft and with the pivot shaft at the proximal end of the elongate hole, the catch shaft clears the opening of the stacked receptacles and the cheek piece can pivot about the pivot shaft; and a spring detent operatively associated with one of the pivot shaft and the catch shaft, the spring detent preventing relative movement between the pivot shaft and the proximal and distal ends of the elongate hole without application of a lengthwise force to the cheek piece in a desired lengthwise direction of movement sufficient to overcome the spring detent.

2. The firearm butt stock of claim 1 wherein the spring detent comprises the elongate hole being peanut-shaped with a proximal lobe and a distal lobe separated by waist, the waist having a width less than a diameter of the pivot shaft, and at least one of the cheek piece and the pivot shaft being formed of a resilient material.

3. The firearm butt stock of claim 2 further comprising the cheek piece having a pair of the peanut-shaped holes axially aligned in the left and right sidewalls and the elongate base having a pair of the pivot shafts axially aligned and extending from the right side and the left side of the stock base near the stock base top, the left and right pivot shafts being received in the left and right peanut-shaped holes respectively.

4. The firearm butt stock of claim 3 further comprising the cheek piece side walls defining opposing lengthwise slots forming the plurality of lengthwise stacked receptacles and the elongate base has a pair of the catch shafts axially aligned and extending from the right side and the left side of the stock base near the stock base top receivable in the lengthwise stacked receptacles.

5. The firearm butt stock of claim 2 wherein the cheek piece and the pivot shafts are formed of the same resilient material.

6. The firearm butt stock of claim 2 wherein the cheek piece is integrally formed of a resilient polymer.

7. The firearm butt stock of claim 6 wherein the elongate stock base is integrally formed from the resilient polymer.

8. The firearm butt stock of claim 1 further comprising the cheek piece side walls defining opposing lengthwise slots in an inner surface forming the plurality of lengthwise stacked receptacles and the elongate base has a pair of the catch shafts axially aligned and extending from the right side and the left side of the stock base near the stock base top receivable in the lengthwise stacked receptacles.

9. The firearm butt stock of claim 1 further comprising the plurality of lengthwise stacked receptacles being two.

10. The firearm butt stock of claim 1 wherein the cheek piece and the pivot shafts are formed of the same resilient material.

11. The firearm butt stock of claim 1 wherein the cheek piece is integrally formed of a resilient polymer.

12. A firearm comprising:

an upper receiver;

a grip housing;

a barrel; and a butt stock, the butt stock comprising:

an elongate stock base having a top, a bottom, a right side, a left side, a proximal end and a distal end, the stock base having a transverse pivot shaft near the stock base top and a transverse catch shaft spaced from the pivot shaft lengthwise of the stock near the stock base top;

a cheek piece having a proximal end, a distal end and left and right sidewalls, the cheek piece defining a plurality of lengthwise stacked receptacles opening toward a proximal end of the cheek piece between the sidewalls and an elongate hole having a distal and a proximal end spaced lengthwise and distal of the stacked receptacles, the stacked receptacles, the catch shaft, the elongate hole and the pivot shaft being configured so that with the pivot shaft received in the elongate hole and the pivot shaft at the distal end of the elongate hole, the catch shaft is received in one of the stacked receptacles and the cheek piece is prevented from pivoting about the pivot shaft and with the pivot shaft at the proximal end of the elongate hole, the catch shaft clears the opening of the stacked receptacles and the cheek piece can pivot about the pivot shaft; and a spring detent operatively associated with one of the pivot shaft and the catch shaft, the spring detent preventing movement of the pivot shaft between the proximal and distal ends of the elongate hole without application of a lengthwise force to the cheek piece in a desired lengthwise direction of movement sufficient to overcome the spring detent.

13. The firearm of claim 12 wherein the spring detent comprises the elongate hole being peanut-shaped with a proximal lobe and a distal lobe separated by waist, the waist having a width less than a diameter of the pivot shaft, and at least one of the cheek piece and the pivot shaft being formed of a resilient material.

14. The firearm of claim 13 further comprising the cheek piece having a pair of the peanut-shaped holes axially aligned in the left and right sidewalls and the elongate base having a pair of the pivot shafts axially aligned and extending from the right side and the left side of the stock base near the stock base top, the left and right pivot shafts being received in the left and right peanut-shaped holes respectively.

15. The firearm of claim 14 further comprising the cheek piece side walls defining opposing lengthwise slots forming the plurality of lengthwise stacked receptacles and the elongate base has a pair of the catch shafts axially aligned and extending from the right side and the left side of the stock base near the stock base top receivable in the lengthwise stacked receptacles.

16. The firearm of claim 12 further comprising the cheek piece side walls defining opposing lengthwise slots forming the plurality of lengthwise stacked receptacles and the elongate base has a pair of the catch shafts axially aligned and extending from the right side and the left side of the stock base near the stock base top receivable in the lengthwise stacked receptacles.

17. The firearm butt stock of claim 16 wherein the elongate stock base is integrally formed from the resilient polymer.

* * * * *